United States Patent [19]

Uetani

[11] Patent Number: 4,473,134

[45] Date of Patent: Sep. 25, 1984

[54] GROUP SUPERVISORY CONTROL SYSTEM FOR ELEVATOR

[75] Inventor: Kenichi Uetani, Inazawa, Japan

[73] Assignee: Mitsubishi Denki Kabushiki Kaisha, Tokyo, Japan

[21] Appl. No.: 449,995

[22] Filed: Dec. 15, 1982

[30] Foreign Application Priority Data

Mar. 24, 1982 [JP] Japan ..... 57-46549

[51] Int. Cl.[3] ..... B66B 1/18

[52] U.S. Cl. ..... 187/29 R

[58] Field of Search ..... 187/29; 364/200, 900

[56] References Cited

U.S. PATENT DOCUMENTS 3,593,825 7/1971 Gieseler ..... 187/29

4,410,959 10/1983 Tajima et al. ..... 187/29 X 4,411,338 10/1983 Kuzunuki et al. ..... 187/29

*Primary Examiner*—J. V. Truhe

*Assistant Examiner*—W. E. Duncanson, Jr.

*Attorney, Agent, or Firm*—Oblon, Fisher, Spivak, McClelland & Maier

[57] ABSTRACT

The disclosure concerns a group supervisory control system for an elevator having statistical traffic data for the elevator from a past time interval and controlling the operation of the car dependent on the statistical data wherein the system comprises an operating apparatus which detects the distinction points of the variation of the traffic data to output traffic data and time for the distinction points as statistical data.

10 Claims, 13 Drawing Figures

GROUP SUPERVISORY CONTROL SYSTEM FOR ELEVATOR

BACKGROUND OF THE INVENTION

1. Field of the Invention

The present invention relates to an improved apparatus for group supervisory control system for an elevator.

2. Description of the Prior Art

In the typical group supervisory control system for an elevator system, when a hall call is registered, an elevator car suitable for responding to the hall call is selected dependent on data required for the group supervisory control, whereby the hall call is allocated to a use car.

Proposals have been made in publications such as the Japanese Unexamined Patent Publication No. 115566/1980 in which a day is divided into a plurality of time zones, and traffic and service data for an elevator are statistically gathered for each previous time zone in order to perform group supervisory control for elevator cars.

The conventional system is illustrated in FIGS. 1 to 3.

In the FIG. 1, the reference numeral (1) designates a car controlling apparatus for controlling cars (only one apparatus is shown in the figure); (1*a*) designates car condition data such as a car call, car load, car direction; (2) designates a group supervisory control system; (2*a*) designates data for statistics such as car condition for each car, waiting time of a hall call, and an estimated floor for response; (2*b*) designates a group supervisory data such as the floor allocated by the hall call; (2*c*) designates a hall call registration releasing signal; (3) designates a statistical apparatus for statistic operation of traffic and service data for an elevator; (3) designates statistical data such as a hall call probability, a car call probability, the passenger entering times at each floor; (4) designates exterior apparatuses such as a hall call detection apparatus and a waiting passenger number detection apparatus; (4*a*) designates a hall signal such as a hall button signal and a signal indicating number of waiting passengers.

In FIG. 2, the reference numerals (5*a*), (5*b*), . . . (5*x*) designate time zone signals in which (5*a*) designates the time zone signal which is in the "H" level during the time from 7 a.m. to 8 a.m., (5*b*) designates the time zone signal corresponding to the time from 8 a.m. to 9 a.m., . . . (5*x*designates the time zone signal corresponding to the time from 6 a.m. to 7 a.m. That is, each time an up call button at the first floor is operated, the number of the operations is counted, memorized and totalized for each time zone. For example, call times during one hour from 6 a.m. to 7 a.m., when the time zone signal (5*a*) changes to "H", are added to the call times in the hour from 6 a.m. to 7 a.m. which are totaled from the previous day. Furthermore, an average of the up call times in one hour of the time zone per day is calculated dependent on the past days. Similarly, when the time zone signal (5*b*) changes to "H", an average of the up call times in one hour from 7 a.m. to 8 a.m. per day is calculated. The same performance is given for other time zones. Thus, the call times signal indicating an average of the call times is supplied to the group supervisory control system (2) as statistical data to perform group supervisory control.

The traffic condition (load) of an elevator greatly varies dependent on time zones as shown in FIG. 3.

There are time zones of almost non-traffic condition as in offices and buildings at night and time zones utilized by a great number of people in a short time such as their arrival at the offices in the morning. In a statistical method using fixed time zones as shown in the time axis TA, satisfactory data cannot be obtained because of limited memory for statistics. It is difficult to detect a sharp rise of traffic required for statistical data.

SUMMARY OF THE INVENTION

Accordingly, one object of this invention is to provide a novel system which overcomes the disadvantage of the conventional system and which provides a group supervisory control system for an elevator for detecting distinction points in the variation of traffic data in order to output traffic data and time indication for the distinction points as statistical data whereby precise statistical data can be obtained even with limited memory capacity to thereby provided improved services.

The foregoing and the other objects of the present invention have been attained by providing a group supervisory control system for an elevator having statistical traffic data collected for the elevator from a previous operation interval and controlling the operation of a car dependent on the statistic data, which comprises a traffic data recording circuit for recording traffic data for an elevator from a previous interval of operation, the recording being carried out in relation to time, a distinction point detecting circuit for detecting distinct data among the data recorded in the traffic data recording circuit, and a distinction point recording circuit for recording the distinct traffic data detected by the distinction point detecting circuit and the time to output the recorded data as the statistical data.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
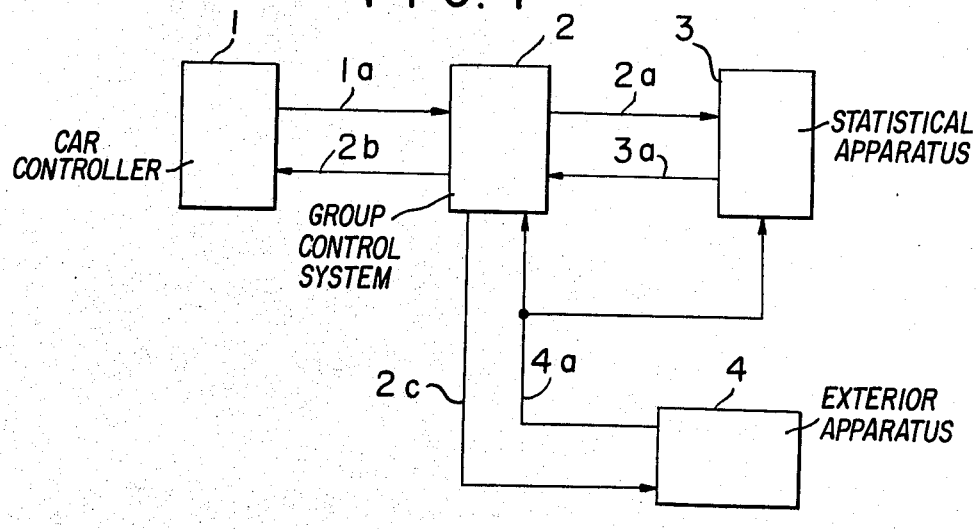
FIG. 1 is a block diagram of the conventional group supervisory control system.
Figure 2:
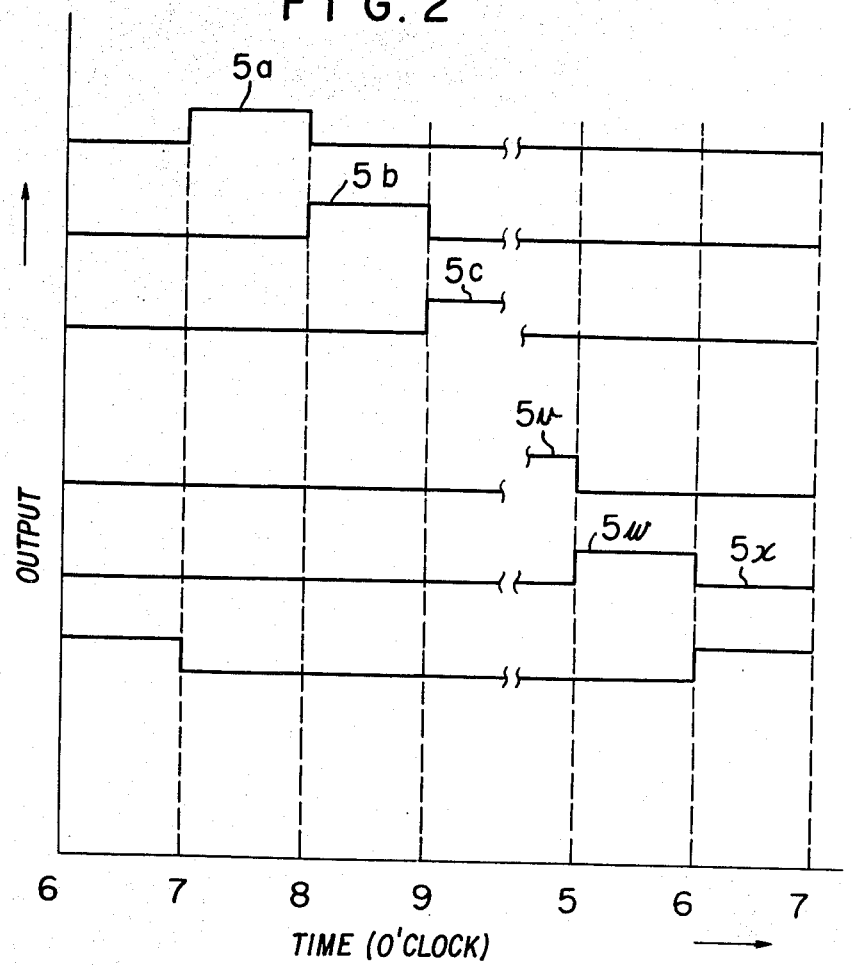
FIG. 2 is a schematic view showing time zones in the system of FIG. 1.

Referring now to the drawings, wherein like reference numerals designate identical or corresponding parts throughout the several views, there is disclosed an embodiment of the present invention, with reference to FIGS. 4–10, in which statistical data is obtained concerning an increased load at the first floor in the up direction. In the FIGURES, the suffixes "-1" to "-3" of the references respectively designate cars No. 1 to No. 3 and the suffixes "A", "B", "C", . . . "N" of the references respectively designate the first, the second, the third, . . . the Nth time. An apparatus for obtaining statistical data will be described with reference to drawings wherein arrangement of the apparatus with regard to the other apparatus and devices, such as a group supervisory control system, a car controlling apparatus, a hall call detection apparatus, a waiting passenger number detection apparatus, etc., is the same as that of FIG. 1.

In the FIGS. 4 to 10, the reference (10) designates a time signal produced by a clock (not shown); (11) designates increased load signals each expressed as a percentage of a car load increased by entrance of passengers in the car in responsive to the up call at the first floor to a carrying load of the car (the maximum load to be carried); (12) designates a door closing pulse signal (an adding timing pulse), each of which changes to "H" by the closing of a door after the car stops in response to a hall call and door opening; (13) designates gate circuits for outputting an input I when the input G becomes "H"; (14) designates an adder for adding the inputs A–C to output a signal; (15) designates an OR gate; (16) and (17) designate gate circuits the same as the gate circuits (13); (18) designates a pulse signal which is produced at 0:00 a.m.; (19) designates a shift register which changes only an output $P_0$ to "H" by resetting data when an input R changes to "H" the "H" level being sequentially shifted for the outputs $P_1$, $P_2$ . . at each time when an input S changes to "H", however, the output $P_0$ is not used in the embodiment shown in the FIG. 4 and the outputs $P_1$, $P_2$ . . . are used whereby when the input R changes to "H", $P_1$ firstly changes to "H" and $P_2$, $P_3$ . . . sequentially change to "H" in accordance with each input S, and (20) designates traffic data recording circuits such as increased load outputting circuits. In one circuit (20A) among the several recording circuits, the reference numerals (20AA), (20BA) designate gate circuits the same as the gate circuits (13); (20CA), (20DA) designate recording circuits for memorizing inputs to output signals; (20*a*A) designates a time signal as the output of the recording circuit (20CA), and (20*b*A) designates a load signal as the output of the recording circuit (20DA). The same structure is provided in the other circuits (20B), (20C), . . . .

Figure 5:
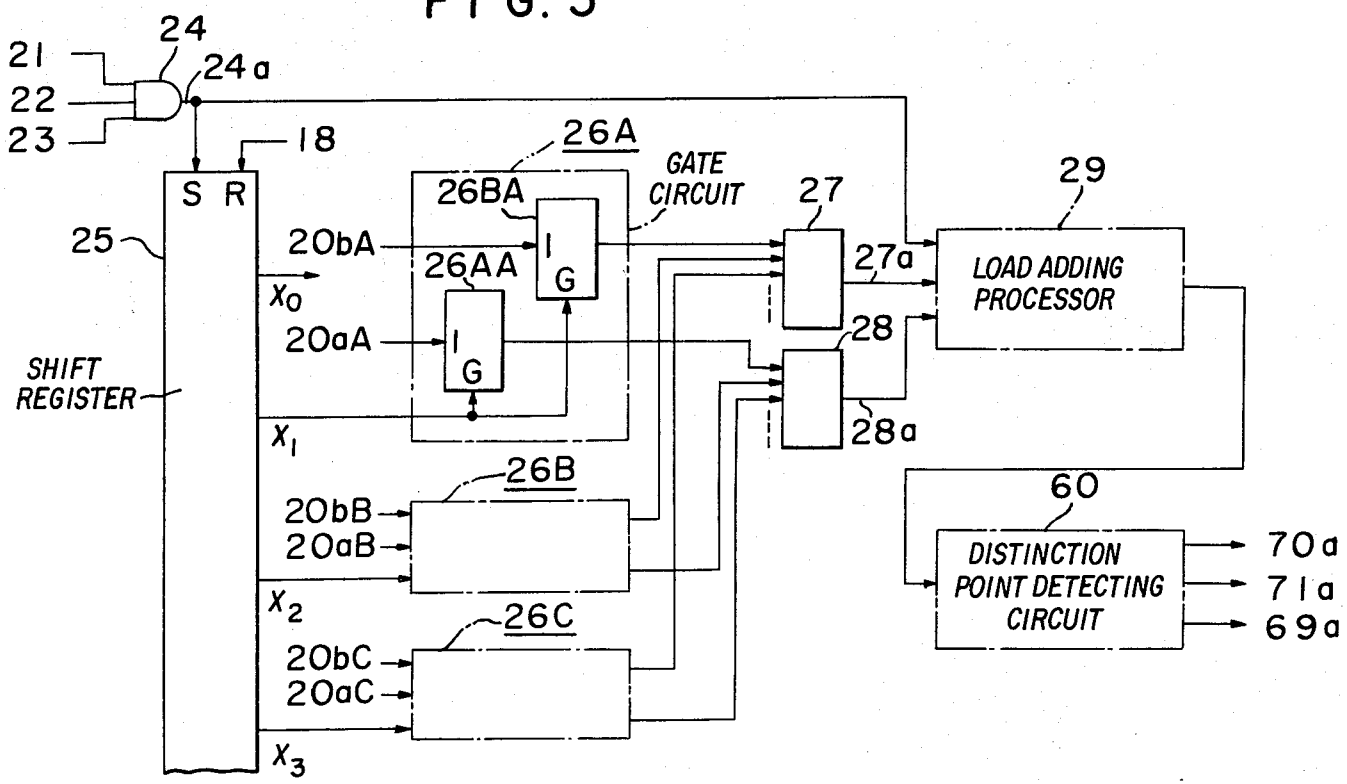

Referring to FIG. 5, (21) designates a scanning pulse having a sufficiently short frequency to finish scanning in 30 seconds, e.g., at least 100 Hz; (22) designates a read-out signal which changes to "H" at, for example, 11:59 p.m.; (23) designates a read-out completion signal which changes to "L" at a short time (such as 30 seconds) after the read-out signal (22) changes to "H"; (24) designates an AND gate, (24*a*) designates the output of the AND gate; (25) designates a shift register the same as the shift register (19); and (26) designates increased load gate circuits. In the gate circuit (26A), the reference numerals (26AA), (26BA) designate gate circuits the same as the gate circuits (13) (Gate circuits (26B), (26C), . . . also have the same structure as the gate circuit (26A)); (27) designates an OR gate circuit; (27*a*) designates the output of the OR gate as an increased load signal; (28) designates an OR gate circuit; (28*a*) designates the output as a time signal; and (29) designates a load adding processor.

Figure 6:
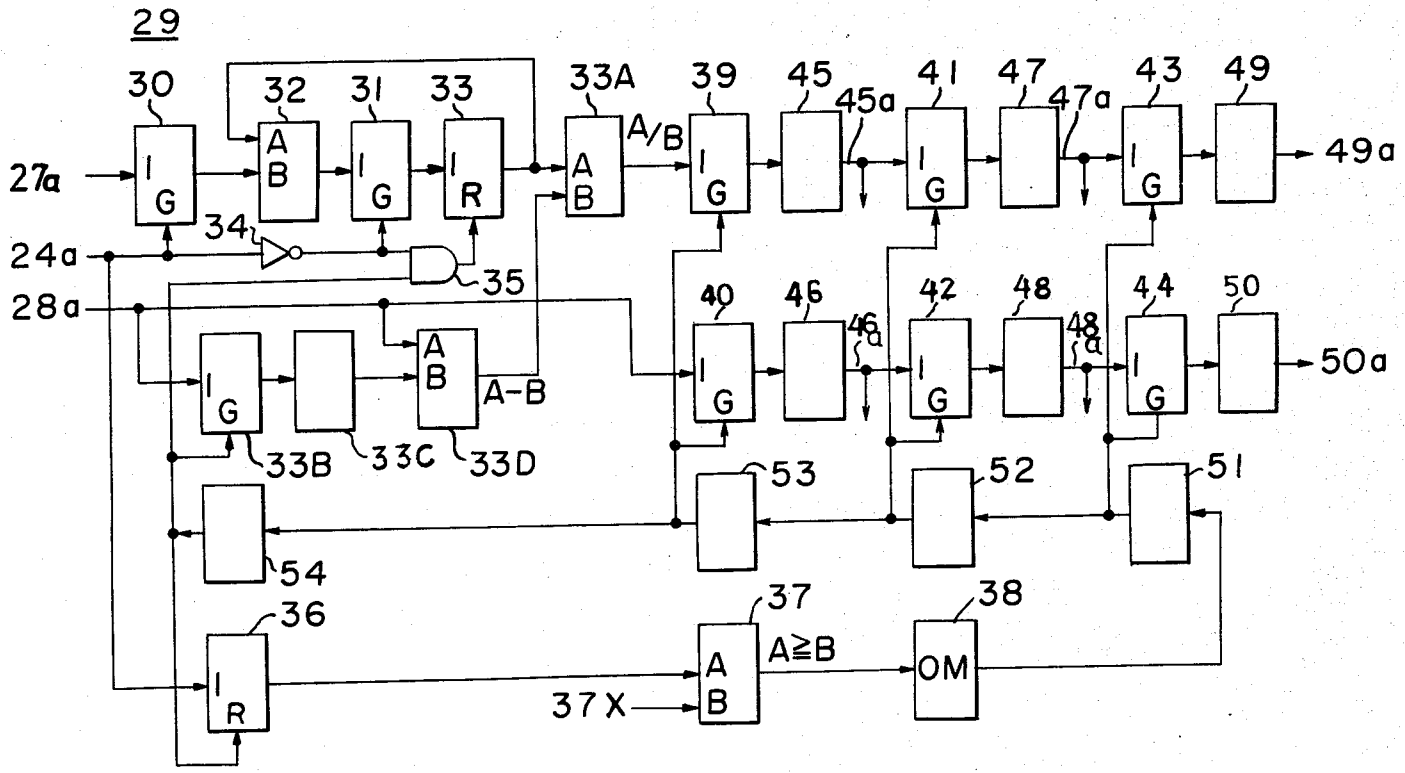

FIG. 6 illustrates the detail of the processor (29) in which the reference numerals (30), (31) designate gate circuits similar to the gate circuits (13); (32) designates an adder for summing the input A and the input B; (33) designates a recording circuit which memorizes the input A to output it and is reset to be zero data when the input R changes to "H"; (33A) designates a divider for outputting a value obtained by dividing the input A by the input B, (33B) designates a gate circuit as the gate circuit (13), (33C) designates a recording circuit identical to the recording circuit (20C), (33D) designates a subtractor for subtracting the input B from the input A; (34) designates a NOT gate; (35) designates an AND gate; (36) designates a counter which counts the number of change of the input I to the "H" level and is reset to be zero data when the input R changes to "H"; (37) designates a comparator for comparing the input A with the input B so that the output changes to "H" when input A≧input B, otherwise in the "L" level; (37X) designates a constant value signal corresponding, for example, to 10 (10 stop occurrences); (38) designates a monostable device for producing output of "H" level for a predetermined time when the input changes to "H"; (39)–(44) designate gate circuits identical to the gate circuits (13); (45)–(50) designate recording circuits identical to the recording circuit (20C); (45*a*)–(50*a*) respectively designate the output of the recording circuits (45)–(50); and (51)–(54) designate delay circuits which produce the output of "H" level with a predetermined time delay when the input changes to "H".

Figure 7:
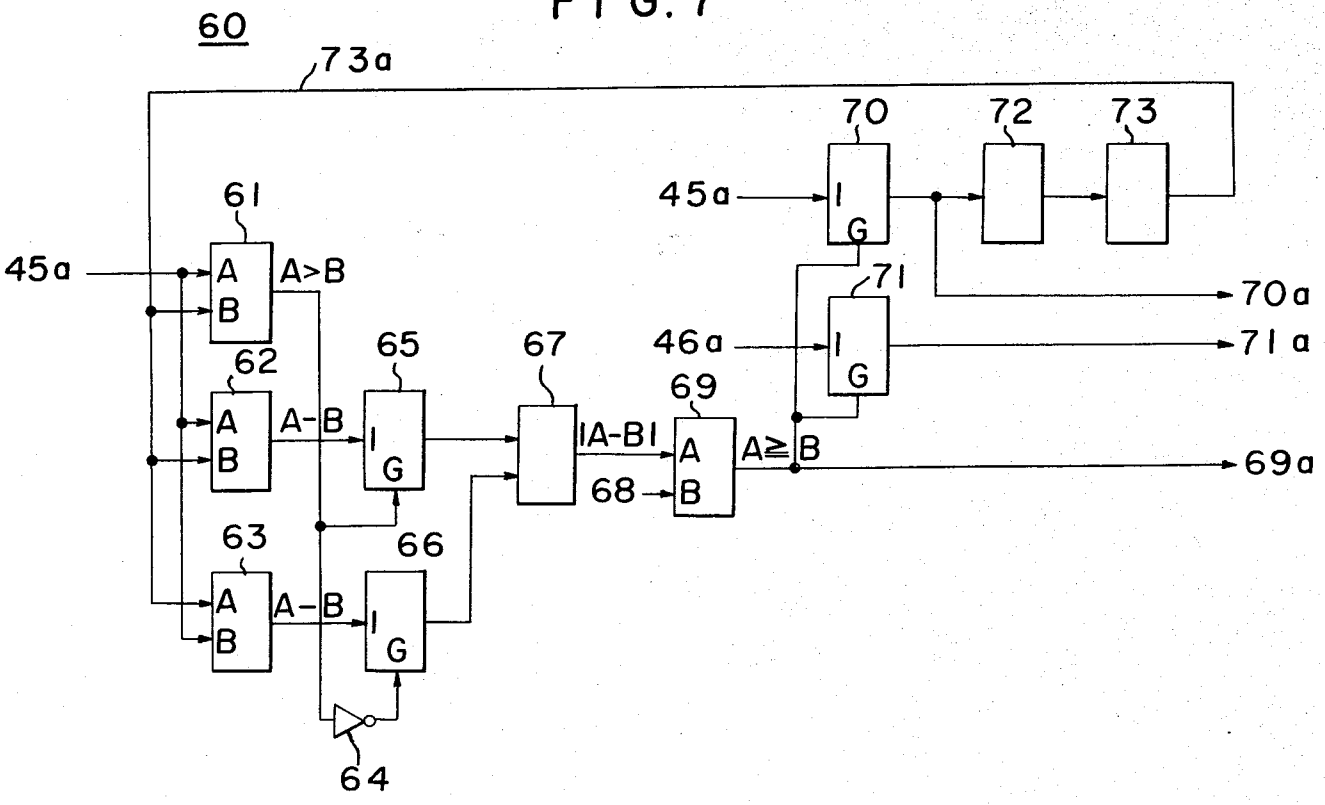

FIG. 7 illustrates the detail of the distinction point detecting circuit (60) shown in FIG. 5 in which the reference numeral (61) designates a comparator for producing the output of "H" level when input A>input B; (62), (63) designate subtractors identical to the subtractor (33D); (64) designates an inverter; (65), (66) designate gate circuits the same as the gate circuits (13); (67) designates an OR gate circuit; (68) designates a constant load signal which corresponds, for example, to a value of 30 percent of the carrying load of the car; (69) designates a comparator identical to the comparator (37) with its output (69*a*); (70) designates a gate circuit identical to the gate circuit (13) with its output (70*a*); (71) also designates a gate circuit with its output (71*a*); (72) designates a delay circuit identical to the delay circuit (51), and (73) designates a recording circuit identical to the recording circuit (20C) with its output (73*a*).

Figure 8:
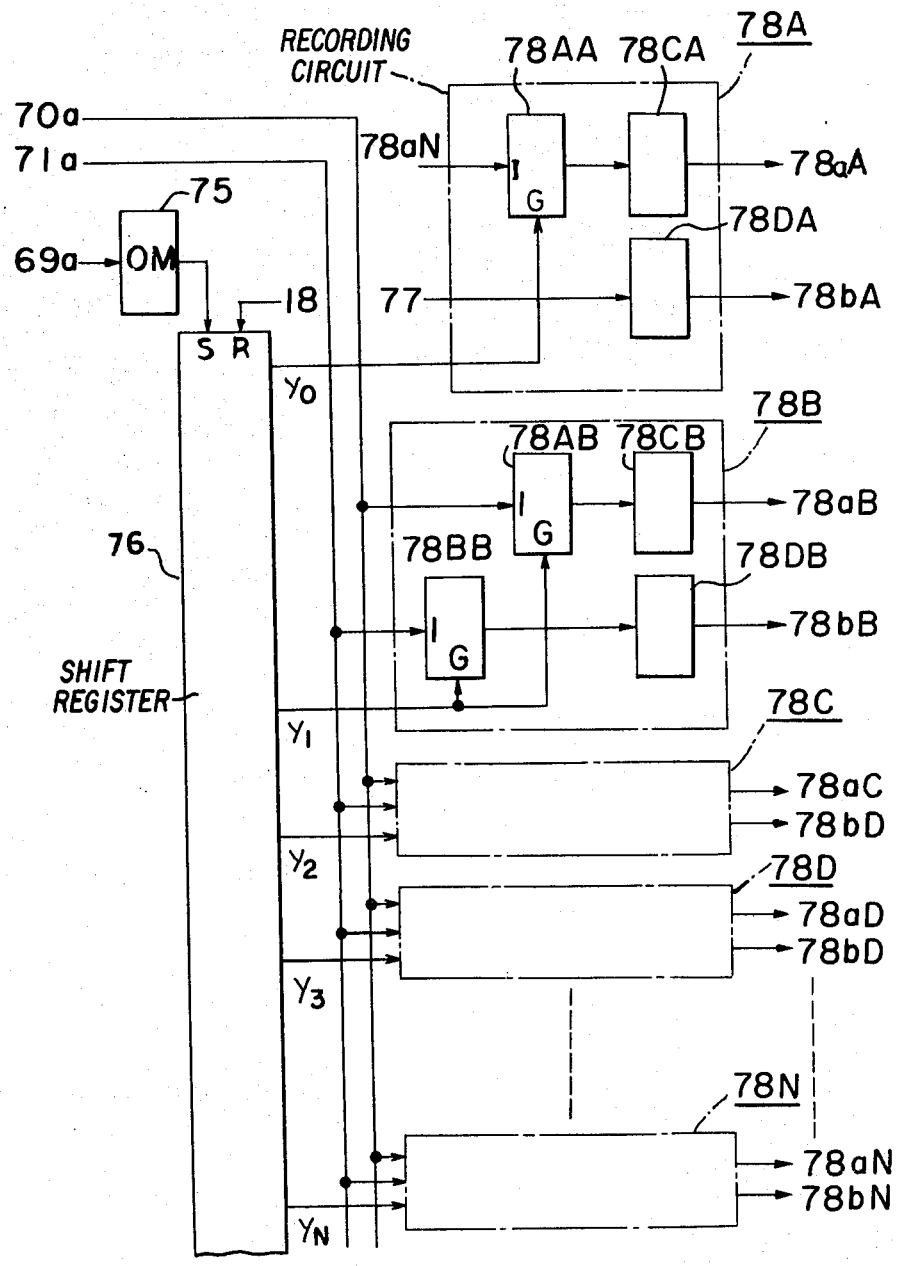

In FIG. 8, the reference numeral (75) designates a monostable device similar to the monostable device (38); (76) designates a shift register identical as the shift register (19); (77) designates a signal corresponding to 0:00 a.m. and (78) designates distinction point recording circuits. In one recording circuit (78B), the reference numerals (78AB), (78BB) designate gate circuits identical to the gate circuits (13); (78CB) and (78DB) designate recording circuits similar to the recording circuit (20C); (78*a*A), (78*a*B), . . . (78*a*N) respectively designate the output of the recording circuits (78CA), (78CB), . . . (78CN) as an increased load/unit time signal; and (78*b*A), (78*b*B), . . . (78*b*N) respectively designate the output of the recording circuits (78DA), (78DB), . . . (78DN) as a time signal.

Figure 9:
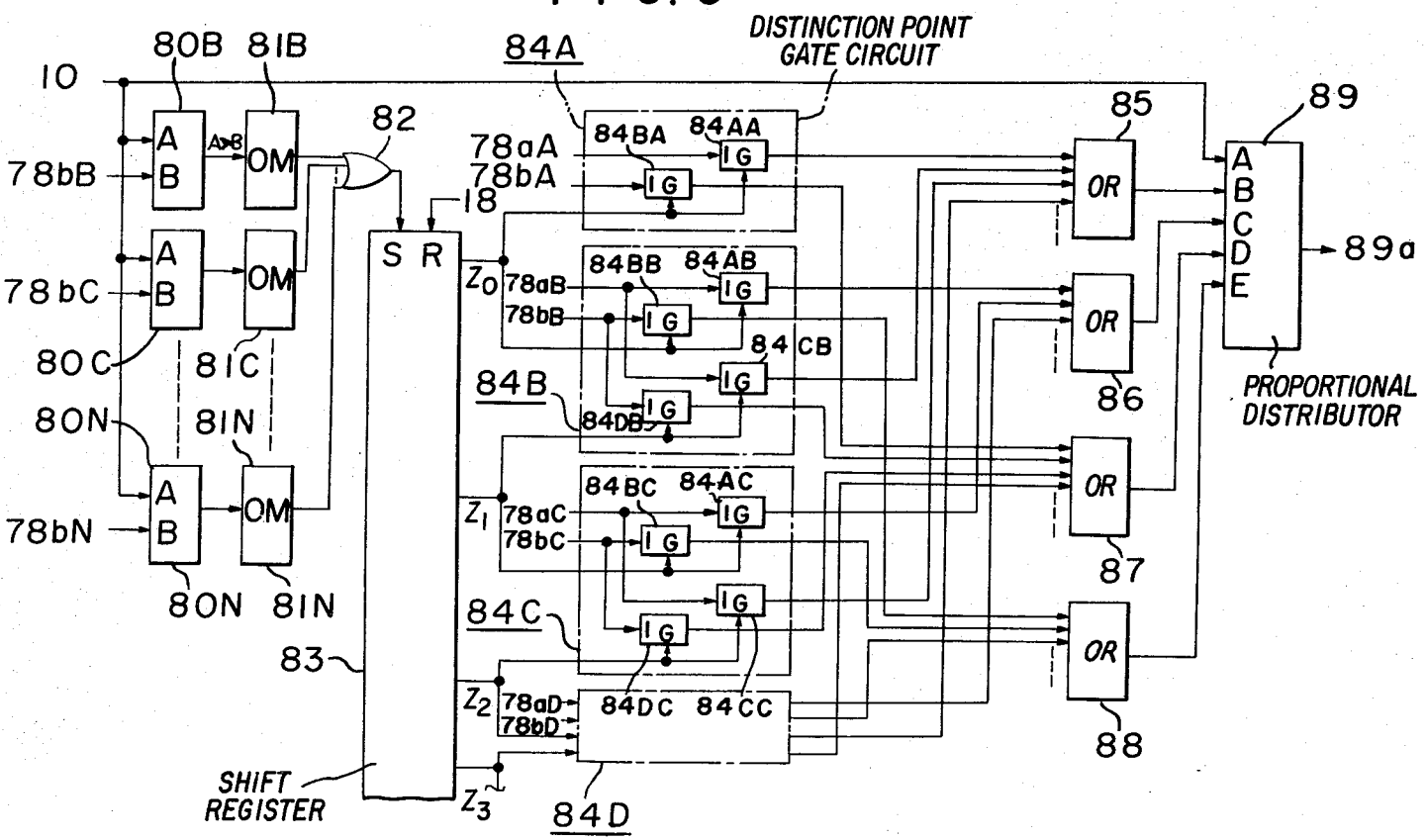

In FIG. 9, the reference numerals (80B), (80C), . . . (80N) designate comparators identical to the the comparator (61); (81B), (81C), . . . (81N) designate monostable devices similar to the monostable device (38); (82) designates an OR gate; (83) designates a shift register identical to the shift register (19); and (84A), (84B), . . . (84N) designate distinction point gate circuits. In the distinction point gate circuit (84B), the reference numerals (84AB)–(84DB) designate gate circuits the same as the gate circuits (13) (the same structure is given to other gate circuits); (85)–(88) designate OR gate circuits; (89) designates a proportional distributor which calculates $$F = C + (B - C) \times \frac{A}{E - D}$$

when input B>input C and $$F = B + (C - B) \times \frac{A}{E - D}$$

when input B<input C; and (89*a*) designates the output of the proportional distributor as an estimated increased load/unit time signal for an up call at the first floor.

Figure 10:
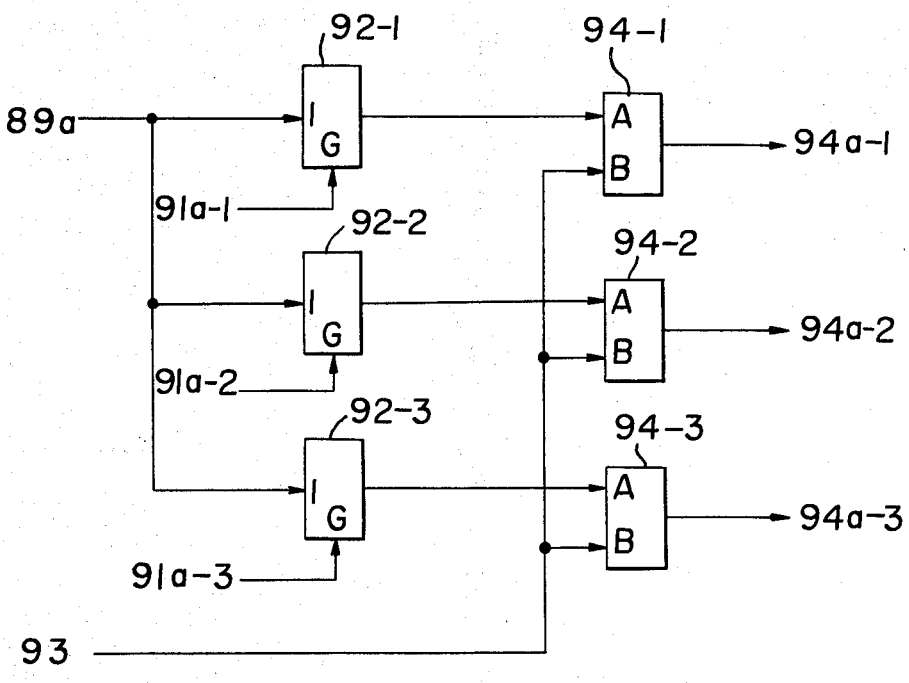

In FIG. 10, the reference numeral (91*a*) designates an up call allocation signal which changes to "H" when an up call at the first floor is allocated to a car; (92) designates a gate circuit the same as the gate circuit (13); (93) designates a constant signal for modifying the estimated increased load/unit time signal (89*a*); (94) designates a multiplyer for multiplying the input A by the input B; and (94*a*) designates the output of the multiplier as an up call passenger load estimation signal on the first floor.

The operation of the embodiment with be described.

The increased load signal (11-1), (11-2) or (11-3) of each car is output through the gate circuit (13-1), (13-2) or (13-3) at each closing of the door and the outputs added in the adder (14). The output of the OR gate (15) is changed to "H" at each time of closing the door to open the gate circuits (16), (17). Since the shift register (19) is reset by the signal (18) at 0:00 a.m. (the other shift register (25) also operate in the same manner), the output $P_1$ becomes "H". The output, i.e. increased load signal, of the adder (14) is recorded in the recording circuit (20DA) through the gate circuits (17), (20BA) to generate the output (20*b*A). At the same time, the time signal (10) is recorded in the recording circuit (20CA) through the gate circuits (16), (20AA) to generate the output (20aA). When the car stops and the output of the OR gate (15) changes to "H" due to a door closing pulse signal (12), the output $P_1$ of the shift register (19) changes to "L" and the output $P_2$ changes to "H" thereby generating the outputs (20*a*B), (20*b*B) from the second increased load outputting circuit (20B). Thus, the time at which each car stops and each time the load is increased for each car in a day are recorded for outputting.

The AND gate (24) is opened at the time when the read-out signal (22) becomes "H" at 11:59 p.m. and is kept in "H" level until the read-out completion signal (23) becomes "L" after 30 seconds from the changing whereby the output (24*a*) is given as a pulse dependent on the scanning pulse (21). With this pulse, the outputs $X_1$, $X_2$, $X_3$ . . . of the shift register (25) sequentially become "H" to scan the first, the second, the third increased load gate circuits (26A) (26B), (26C) . . . . That is, when the output $X_1$ changes to "H", the gate circuits (26AA), (26BA) are opened to output the signals (20*a*A), (20*b*A). Similarly, the outputs are generated from the second and the third increased load gate circuits (26B), (26C) . . . . Data of each increased load are passed through the OR gate circuit (27) to be the increased load signal (27*a*) and data of time are passed through the OR gate circuit (28) to be the time signal (28*a*). The increased load signal (27*a*) is input into the adder (32) at each time the output (24*a*) changes to "H" which causes the opening of the gate circuit (30) and the increased load signal is added to the data of the increased load which have been recorded in the recording circuit (33). When the output (24*a*) changes to "L", the output of the NOT gate (34) changes to "H" to open the gate circuit (31) whereby the data in the adder (32) are recorded in the recording circuit (33). On the other hand, the counter (36) counts the number of times output (24*a*) changes to "H" and the increased load data is stored in the recording circuit (33) until a predetermined number is counted, for example, ten (ten stop occurrences).

When the output of the counter (36) is generated ten times, the output of the comparator (37) changes to "H" and the output of the monostable device (38) is kept in the "H" level for a predetermined period. Then, the output of the delay circuits (51)–(54) sequentially change to "H" to open the gate circuits (43), (44). Then the gate circuits (41), (42) and the gate circuits (39) (40) are sequentially opened whereby the data of the recording circuits (47), (48) is recorded in the recording circuits (49), (50), which respectively generate the output (49*a*), (50*a*). The data of the recording circuits (45), (46) are respectively recorded in the recording circuits (47), (48), which generate the outputs (47*a*), (48*a*). The time signal (28*a*) is stored in the recording circuit (33C) by the opening of the gate circuit (33B) which is caused by the output of the delay circuit (54) changing to "H" and is input to the subtractor (33D) as the time at which the counter (36) has generated the output in previous interval of operation. The subtractor (33D) outputs the difference between the time output from the recording circuit (33*c*) and the time signal as the time required for summing the increased load in the recording circuit (33). The data of the increased load stored in the recording circuit (33) is input into the divider (33A) to be divided by the time output from the subtractor (33D) and is output from the divider (33A) as data indicating the increased load per a unit time (e.g. a minute).

When the monostable device (38) generates the output to change the output of the delay circuit (53) to "H", the increased load per unit time as the output of the divider (33A) is recorded in the recording circuit (45) which generates the output (45*a*), while the time signal (28*a*) is recorded in the recording circuit (46) which in turn generates the output (46*a*). When the output of the delay circuit (54) changes to "H", the recording circuit (33) and the counter (36) are respectively reset to be zero. Thus, an increased load/unit time signal (45*a*) as the datum of increased load for the number of ten (for ten stops) converted by the unit time is provided as well as the time signal (46*a*).

As described below, the increased load/unit time signal (45*a*) is recorded in the recording circuit (73) through the delay circuit (72) upon opening the gate circuit (70). Therefore, during the delaying operation of the delay circuit (72), the recording circuit (73) holds the data of previous number of ten per unit time, that is, the data (73*a*) previously decided as a distinction point. The comparator (61) compares the output (73*a*) with the output (45*a*) and when the output (45*a*)>the output (73*a*), the output of the comparator (61) changes to "H" to open the gate circuit (65) thereby feeding through the output of the subtractor (62). When the output (45*a*)≦the output (73*a*), the output of the comparator (61) changes to "L" and the output of the inverter (64) changes to "H" to open the gate circuit (66) thereby feeding the output of the subtractor (63). These outputs are fed to the OR gate (67) which, in turn, generates the output which represents an absolute value of the difference between the outputs (45*a*) and (73*a*). If the value exceeds the constant load signal (68), the comparator generates a distinction point detecting pulse (69*a*) and then the gate circuits (70), (71) are opened to genetate the increased load/unit time signal (70*a*) and the time signal at the distinction point. Thus, in the control system of the present invention, detection is made for the distinction points when the increased load per a unit time increases over or decreases below a predetermined value and the outputs (45*a*), (46*a*) generated by the detection are indicative of the increased load per a unit time and the time of the distinction points.

Each time when the distinction point detecting pulse (69*a*) changes to "H", the output of the monostable device (75) is in "H" level for a predetermined time and the first, the second . . . the Nth distinction point detecting circuits (78A)-(78N) are scanned whereby the increased load/unit time signals (78*a*A)-(78*a*N) and the time signals (78*b*A)-(78*b*N) at each of the distinction points are generated. As an exception, the increased load/unit time signal at the Nth distinction point in yesterday is generated as a signal (78*a*A) at 0:00 a.m. and the time signal (77) indicating 0:00 a.m. is generated as a signal (78*b*A). The thus generated increased load/unit time signals (78*a*A)-(78*a*N) and the time signals (78*b*A)-(78*b*N) indicate the distinction points from the previous day.

When the time being considered (input signal 10) is prior to the time indicated by the time signal (78*b*B), the output $P_0$ of the shift register (83) is in "H" level and the increased load/unit time signal (78*a*A) is input to the OR gate circuit (85) through the gate circuit (84AA) while the increased load/unit time signal (78*a*B) is input to the OR gate circuit (86) through the gate circuit (84AB). On the other hand, the time signal (78*b*A) is input to the OR gate circuit (87) through the gate circuit (84BA) and the time signal (78*b*B) is input to the OR gate circuit (88) through the gate circuit (84BB). These signals are input to the proportional distributor (89) which generates an estimated increased load/unit time signal (89*a*) at the time being considered. When the time being considered (input signal 10) is over the time indicated by the time signal (78*b*D), the output of the comparator (80B) changes to "H" and the output of the monostable device (81B) is in "H" level for a predetermined time, thus the output of the OR gate (82) is generated as a pulse. The output $P_0$ of the shift register (83), therefore, changes to "L" and the output $P_1$ changes to "H" whereby the increased load/unit time signal (78*a*B) is input to the OR gate (85) through the gate circuit (84CB) and the increased load/unit time signal (78*a*C) is input to the OR gate (86) through the gate circuit (84AC). On the other hand, the time signal (78*b*B) is input to the OR gate circuit (87) through the gate circuit (84DB) and the time signal (78*b*C) is input to the OR gate circuit (88) through the gate circuit (84BC). An estimated increased load/unit time signal (89*a*) is generated from the proportional distributor (89) in the same manner.

When an up call at the first floor is allocated to the car No. 1, the allocation signal (91*a*-1) changes to "H" and the estimated increased load/unit time signal (89*a*) is fed to the multiplier (94-1) through the gate circuit (92-1) in which a constant value (93) is multiplied to generate a modified up-call passenger load estimated value signal (94-1) at the first floor. The operation of the group supervisory control is thus performed dependent on the outputs.

Figure 11:
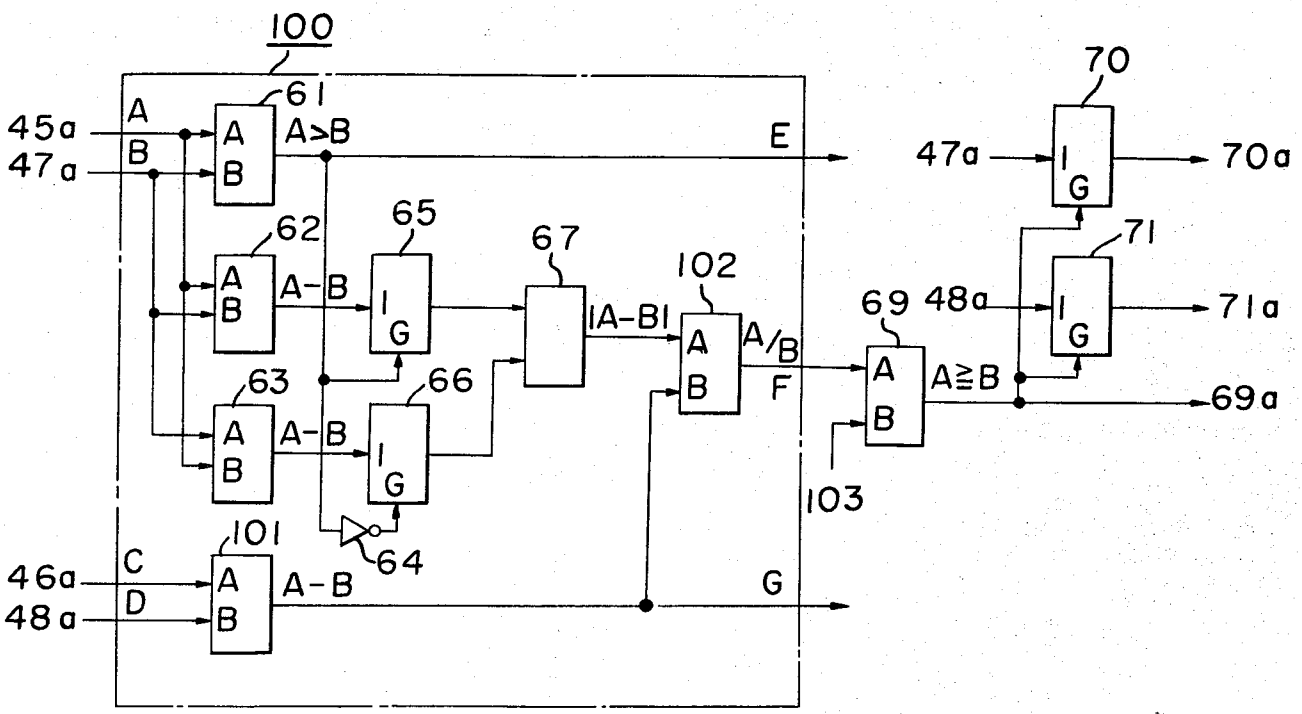
FIGS. 11 and 12 are respectively block diagrams of other embodiments of the present invention.

FIG. 11 illustrates another embodiment of the present invention. The structure of the embodiment is the same as the first embodiment shown in the FIGS. 4 to 6 and 8 to 10.

In FIG. 11, the reference number (100) designates an operating circuit for detecting distinction points; (101) designates a subtractor identical to the subtractor (33D); (102) designates a divider identical to the divider (33A); and (103) designates a signal input to the comparator (69) as a constant value signal corresponding to, for example, 10% load.

The output of the OR gate (67) of FIG. 11 expresses the absolute value of the difference between the output (45*a*) and the output (47*a*), that is, the rate of increase and decrease of a signal of increased load per a unit time. On the other hand, the subtractor (101) calculates the difference between the output (46*a*) and the output (48*a*), that is, time difference corresponding to the increased load/unit time signal. Accordingly, the output of the divider (102) expresses the rate of increase and decrease of the increased load/unit time signal per a unit time (e.g. a minute). If the output exceeds the constant value signal (103), the comparator (69) generates the distinction point detecting pulse (69*a*) to open the gate circuits (70), (71) and a signal (70*a*) expressing the rate of variation of the increased load per unit time at the distinction point and the time signal (71*a*) are generated. Thus, when the increase and decrease of the increased load/unit time signal per a unit time exceeds a constant value, the point is detected as a distinction point and the outputs (47*a*), (48*a*) of the past time at the detection are respectively given as the increased load per a unit time at the distinction point and the time at the distinction point.

Figure 12:
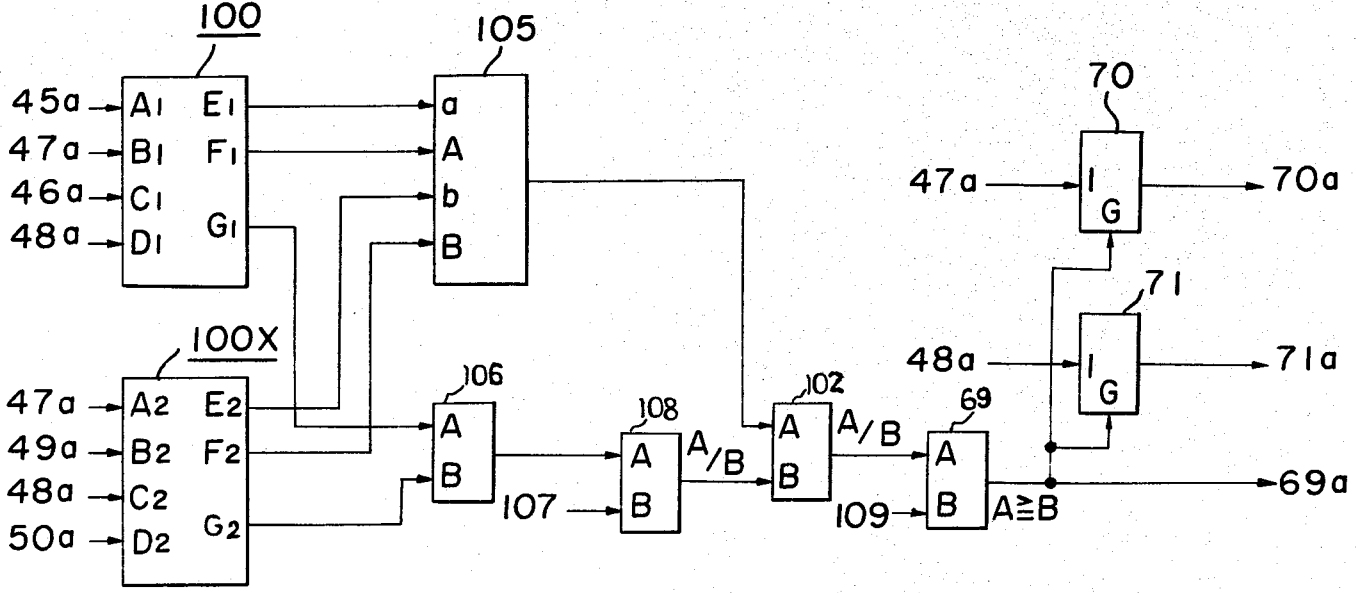

FIG. 12 illustrates a separate embodiment of the present invention. The structure of the embodiment is the same as the first embodiment shown in the FIGS. 4 to 6 and 8 to 10.

In the FIG. 12, the reference numbers (100), (lOOX) designate operating circuits identical to the operating circuit (100) in the FIG. 11 and the input and output signal $A_1$-$G_1$ and $A_2$-$G_2$ respectively correspond to the input and the output signals A-G in the FIG. 11. The reference (105) designates a differential device which calculates the absolute value of an input A − an input B when the input a and the input b have the same sign and calculates an input A + an input B when the input a and the input b have different sign, (106) designates an adder as the adder (32), (107) designates a constant value signal corresponding to "2", (108) designates a divider as the divider (33A) and (109) designates a constant value signal corresponding to, for example, 5% load.

As is clear from the operation of FIG. 11, the FIG. 12 output $E_1$ of the operating circuit (100) is in "H" level when $A_1-B_1$ is positive and otherwise in "L" level and the output E2 of the operating circuit (lOOX) is in "H" level when $A_2-B_2$ is positive and otherwise in "L" level. The output $F_1$ of the operating circuit (100) expresses $|A_1-B_1|/C_1-D_1$, that is, the ratio of the rate of increase and decrease of the increased load/unit time signal per a unit time of the value of the time currently being considered to the value of a previous interval. The output $F_2$ of the operating circuit (100X) also expresses $|A_2-B_2|/C_2-D_2$, that is, the ratio of the rate of increase and decrease of the increased load/unit time per a unit time of the value of a previous interval to the value of another previous interval. The output $G_1$ of the operating circuit (100) expresses $C_1-D_1$, that is, the difference between the time of the current measured interval and the time of a past interval and the output $G_2$ of the operating circuit (100X) expresses $C_2-D_2$, that is, the difference between the time of a past interval and the time of another past interval. Accordingly, the output of the differential device (105) is expressed as $$\frac{|A_1 - B_1|}{C_1 - D_1} - \frac{|A_2 - B_2|}{C_2 - D_2}.$$

Figure 3:
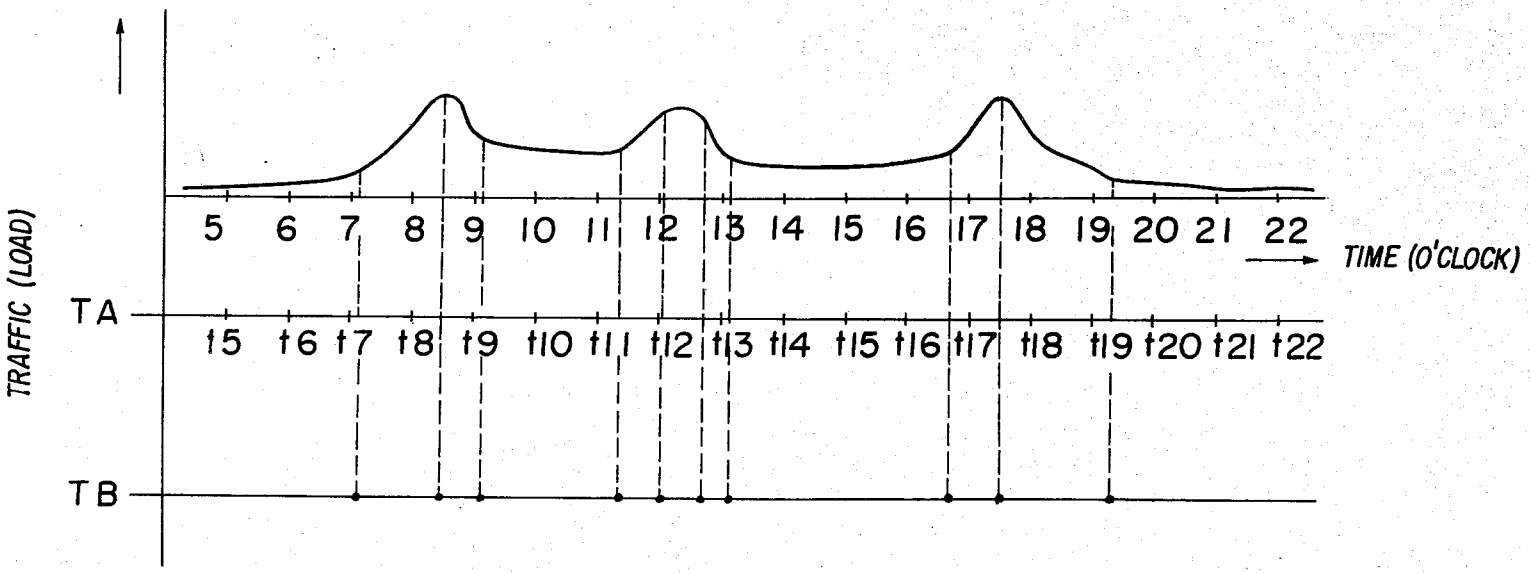
FIG. 3 is a diagram showing traffic variation.
Figure 4:
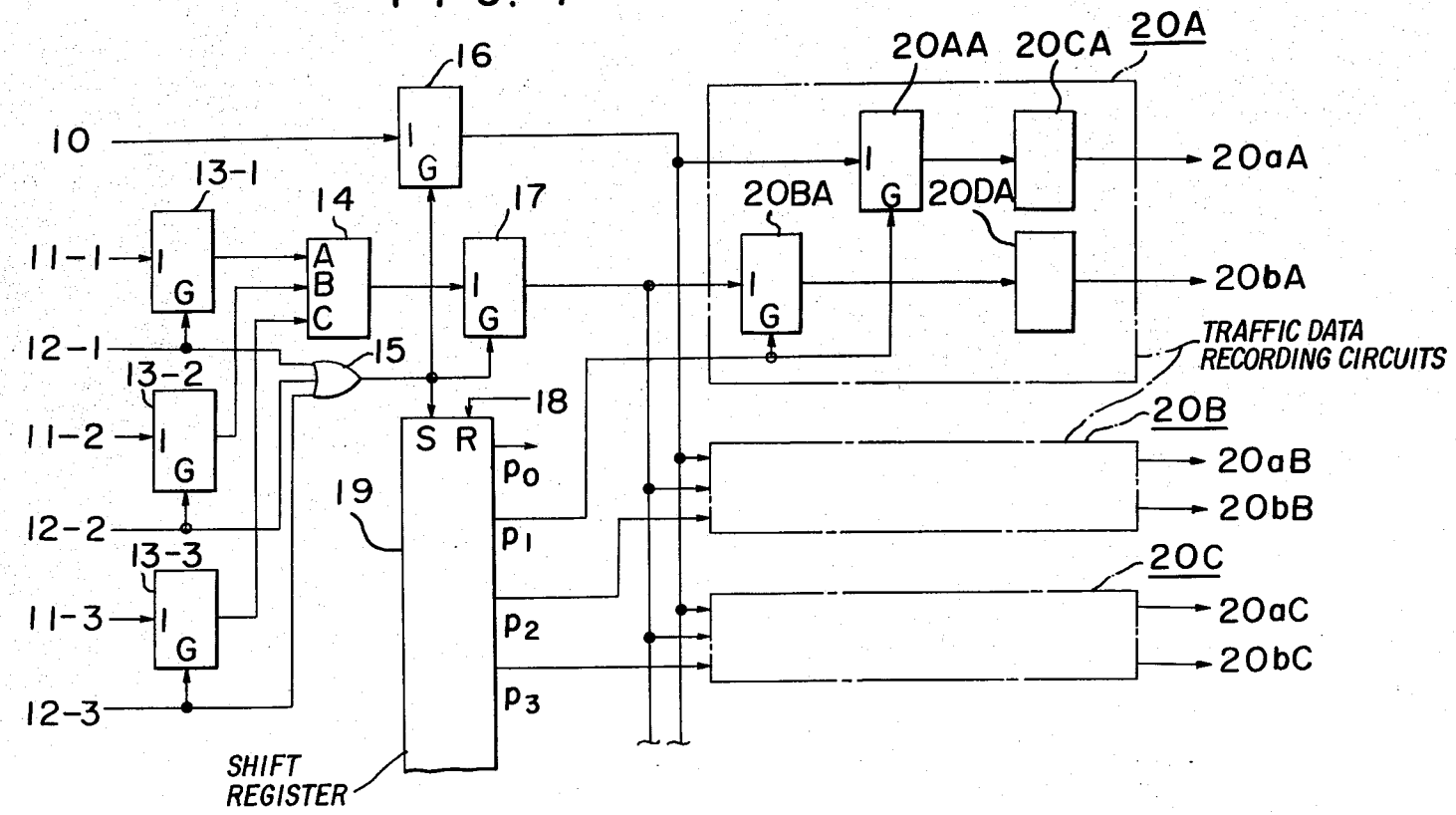
FIGS. 4 to 10 are block diagrams of an embodiment of the group supervisory control system for an elevator according to the present invention.

The output expresses the difference of increase and decrease of the increased load/unit time signal per a unit time. On the other hand, the output of the adder (106) expresses $(C_1-D_1)+C_2-D_2)=C_1-D_2$ (because $D_1=C_2$) and accordingly the output of the divider (108) is given as $C_1-D_2/2$ whereby the output of the divider (102) has a value obtained by dividing the output of the differential device (105) by the output of the divider (108), the value expressing the rate of increase and decrease per a unit time to the rate of increase and decrease of the increased load/unit time signal per a unit time. If the value exceeds the constant value signal (109), the comparator (69) generates the distinction point pulse (69*a*) to open the gate circuits (70), (71) and the increased load/unit time signal (70*a*) and the time signal (71*a*) at the distinction point are generated. Thus, the rate of increase and decrease of the increased load/unit time signal per a unit time (e.g. a minute) is obtained and the rate of increase and decrease per a unit time (e.g. a minute) is further obtained based on the value and when thus obtained value exceeds a constant value, that point is detected as a distinction point. The values detected during a previous operation time period are decided to be the increased load/unit time and the time at the dinstiction point. The distinction points are shown on the axis TB of FIG. 3 as an example.

Figure 13:
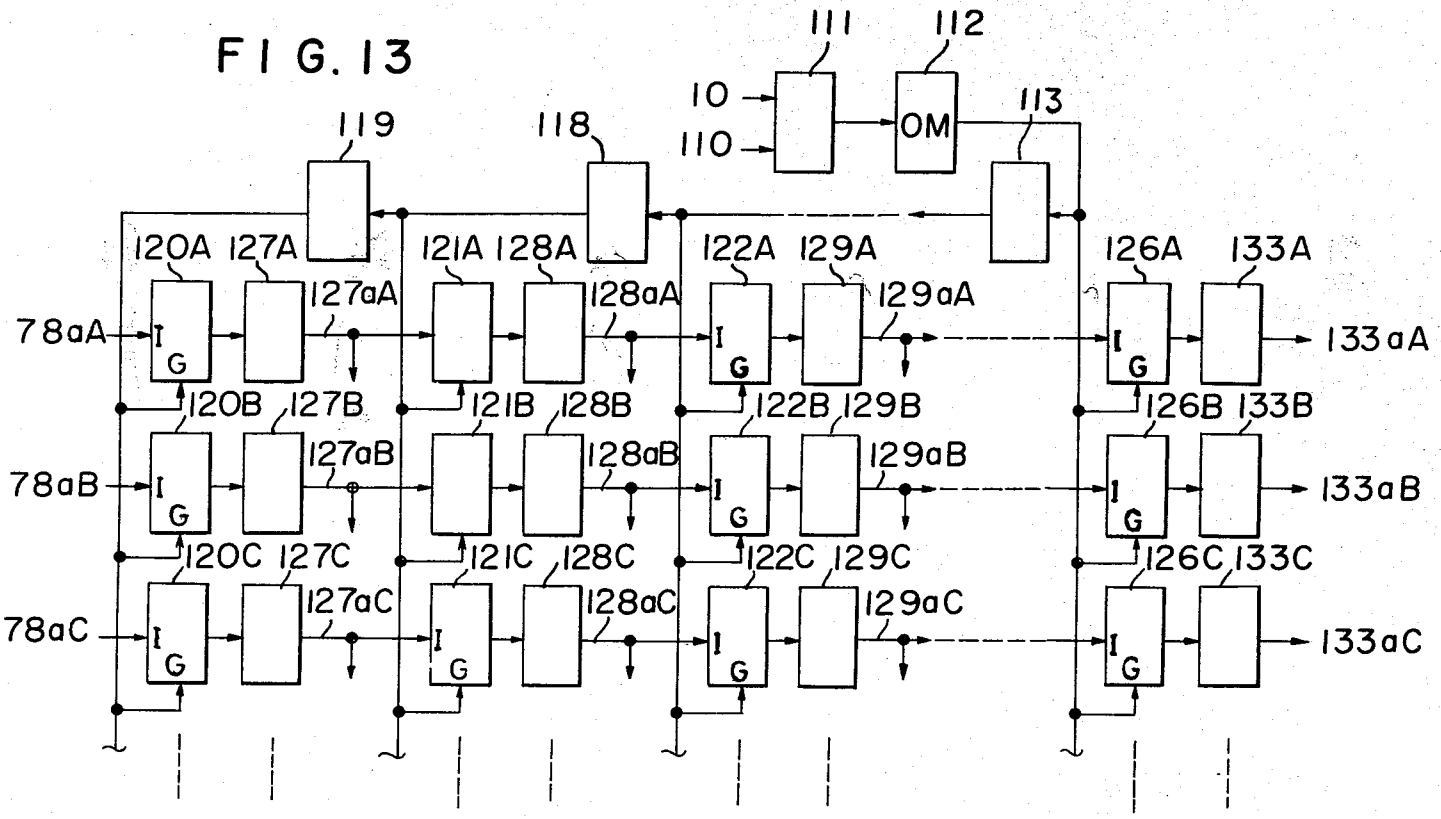
FIG. 13 is a block diagram of another embodiment of the present invention.

FIG. 13 illustrates still another embodiment of the present invention. FIGS. 1 and 4 to 10 are commonly used for this embodiment.

In the embodiment, the increased load unit time signals (78*a*A)-(78*a*N) of FIG. 8 are recorded for a past interval.

In the figure, the reference numberal (110) designates a time signal corresponding to 30 seconds past 11:59 p.m., (111) designates a coincidence detection device whose output changes to "H" when the input A coincides with the input B, (112) designates a monostable device as the monostable device (38), (113)-(119) designate delay circuits as the delay circuit (51), (120)-(126) designate gate circuits as the gate circuit (13), (127)-(133) designate recording circuits as the recording circuits (20C) and (127*a*)-(133*a*) respectively designate the outputs of the recording circuits (127)-(133). At 30 seconds past 11:59 p.m., the output of the coincidence detection device (111) changes to "H" and the monostable device (112) outputs a pulse. The gate circuits (126A), (126B) . . . are opened by the pulse and the data (the increased load/unit time signal six days before) of the memory circuits (125A), (125B) . . . (not shown) in the previous stage are fed to the memory circuits (133A), (133B) . . . to be memorized as an increased load/unit time signal (133*a*A), (133*a*B) seven days before while they increased load/unit time signal which has been memorized as former seven day data is cancelled. Similarly, each of the gate circuits is opened through the respective delay circuits (113)-(119) to sequentially shift the data of the memory circuits one by one in the right direction and finally, the increased load/unit time signals (78*a*A), (78*a*B) . . . of the instant day are memorized in the memory circuits (127A), (127B) . . . . The outputs (127*a*A)-(133*a*A), (127*a*B)-(133*a*B) thus memorized in each of the memory circuits are added by a circuit (not shown) wherein an average value for seven days is obtained. The average value is used as the increased load/unit time signal (78*a*A), (78*a*B) of FIG. 9.

Time signals are also recorded in a circuit having the same structure as described and are used as the time signals (78*b*A), (78*b*B) . . . of FIG. 9.

It is possible that the output (89*a*) of the proportional distributor which is obtained by using the output (127*a*A), (127*a*B) . . . of the recording circuits as the increased load/unit time signals of FIG. 9 and by using time corresponding to the signals as the time signals (78*b*A), (78*b*B) . . . , and the output (89*a*) of the proportional distributor obtained by using the outputs (128*a*A), (128*a*B) . . . of the recording circuits as the increased load/unit time signal of FIG. 9 and by using time corresponding to the signals as the time signals (78*b*A), (78*b*B) . . . are added and the average value of the added value is used in FIG. 10 as an estimated increased load/unit time signal (89*a*) at the present time.

In the embodiment, a case that up call at the first floor is given has been described. It is possible to apply for cases of up call and down call at the other floors and for the total increased load added with the increased loads at all floors.

In the embodiment, data of increased load are used, however, traffic data such as decreased load (load of passenger's exit), length of waiting time, times of hall call, hitting rate of allocated estimation can be also used.

The constant value signals (37X), (68), (103), (109) are not limited to those values, but can be "second", ten minutes or one hour as a unit time.

As described above, in accordance with the present invention, distinct points of variation of elevator traffic data are detected and traffic data and time for the distinct points are output as statistical data to control the operation of car dependent on the statistical data whereby a precise statistical data can be obtained even in a limited memory to improve services of the operation.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the U.S. is:

1. A group supervisory control system for an elevator having statistical traffic data for the elevator from a prior operation time and controlling the operation of the car dependent on the statistical data, which comprises:

a traffic data recording circuit for recording traffic data for the elevator from previous operations, the recording being carried out in relation to time;

a distinction point detecting circuit for detecting distinct data among the data recorded in said traffic data recording circuit; and a distinction point recording circuit for recording the distinct traffic data and the time detected by said distinction point detecting circuit to output the recorded data as statistical data.

2. A group supervisory control system according to claim 1, wherein said distinction point detecting circuit detects distinct points in the variation of the traffic data from the variation rate of the traffic data in relation to time.

3. A group supervisory control system according to claim 2, wherein there is provided on the input side of said distinction point detecting circuit a traffic data processing circuit which performs processing of traffic data recorded in said traffic data recording circuit and dividing the variation rate of the traffic data in a time period by the time and which outputs the variation rate of the traffic data per a unit time.

4. A group supervisory control system according to claim 2, wherein said distinction point detecting circuit has a predetermined reference value in relation to the variation rate and outputs value exceeding the reference value as traffic data.

5. A group supervisory control system according to claim 4, wherein said distinction point detecting circuit has a comparator which receives the variation rate of the traffic data and a reference value as input signals and outputs the variation of the traffic data as output data when the value of variation of the traffic data exceeds the reference value.

6. A group supervisory control system according to claim 1, wherein the traffic data between one distinction point and the other distinction point are obtained by proportional distribution of the variation of the traffic data dependent on the time between the distinction points.

7. A group supervisory control system according to claim 1, wherein there is provided on the output side of said distinction point recording circuit a proportional distributor which receives the traffic data and the time for two distinction points to calculate the variation rates of these traffic data and proportionally distributes said variation rates by dividing the variation rate by the time between the distinction points.

8. A group supervisory control system according to claim 1, wherein data recorded in said distinction point recording circuit are renewed at a predetermined time interval.

9. A group supervisory control system according to claim 1, wherein said distinction point detecting circuit outputs distinct data among the traffic data dependent on the variation rate of the variation of the traffic data in relation to time.

10. A group supervisory control system according to claim 1, wherein an average value of the data for the same time in a previous time interval is used as statistical data for a present time interval.

* * * * *